US006523278B1

(12) United States Patent
Coulson et al.

(10) Patent No.: US 6,523,278 B1
(45) Date of Patent: Feb. 25, 2003

(54) DRYER SECTION

(75) Inventors: Laurie Coulson, Knoxville, TN (US); Kari Juppi, Palokka (FI); Jaakko Kallioniemi, Muurame (FI); Pekka Koivukunnas, Järvenpää (FI); Antti Komulainen, Keuruu (FI); Juha Lipponen, Kerava (FI); Petri Norri, Turku (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/720,743

(22) PCT Filed: Jun. 22, 1999

(86) PCT No.: PCT/FI99/00549

§ 371 (c)(1),
(2), (4) Date: Feb. 20, 2001

(87) PCT Pub. No.: WO00/00693

PCT Pub. Date: Jan. 6, 2000

(30) Foreign Application Priority Data

Jun. 26, 1998 (FI) ..... 981479

(51) Int. Cl.[7] ..... F26B 3/00; F26B 13/30

(52) U.S. Cl. ..... 34/453; 34/456; 34/458; 34/92; 34/94

(58) Field of Search ..... 34/452, 453, 454, 34/455, 456, 457, 458, 494, 92, 94, 111, 621, 657

(56) References Cited

U.S. PATENT DOCUMENTS

| | | | | |
|---|---|---|---|---|
| 3,345,757 A | | 10/1967 | Daane | 34/111 |
| 3,630,424 A | | 12/1971 | Rau | 226/95 |
| 3,816,941 A | | 6/1974 | Holik et al. | 34/116 |
| 4,247,990 A | * | 2/1981 | Ohls et al. | 34/23 |
| 4,357,758 A | | 11/1982 | Lampinen | 34/9 |
| 4,359,828 A | | 11/1982 | Thomas | 34/114 |
| 4,556,450 A | * | 12/1985 | Chuang et al. | 162/204 |
| 5,022,163 A | | 6/1991 | Ilvespää et al. | 34/23 |
| 5,495,678 A | | 3/1996 | Illmarinen et al. | 34/117 |
| 5,515,619 A | | 5/1996 | Kahl et al. | 34/114 |
| 5,625,961 A | | 5/1997 | Ensign et al. | 34/117 |
| 5,630,285 A | * | 5/1997 | Kerttula et al. | 34/446 |
| 5,894,679 A | | 4/1999 | Kuhasalo et al. | 34/117 |
| 5,968,590 A | * | 10/1999 | Ahonen et al. | 427/209 |
| 5,983,523 A | | 11/1999 | Ijäs et al. | 34/445 |
| 6,003,241 A | | 12/1999 | Komulainen et al. | 34/117 |
| 6,003,245 A | * | 12/1999 | Lipponen et al. | 34/457 |
| 6,105,276 A | * | 8/2000 | Ensign et al. | 34/453 |
| 6,128,833 A | | 10/2000 | Juppi et al. | 34/464 |
| 6,145,218 A | * | 11/2000 | Kotitschke et al. | 34/457 |
| 6,228,220 B1 | * | 5/2001 | Hada et al. | 162/203 |
| 6,365,004 B1 | * | 4/2002 | Hamstrom et al. | 162/198 |
| 2001/0045025 A1 | * | 11/2001 | Kahl et al. | 34/454 |

FOREIGN PATENT DOCUMENTS

| | | |
|---|---|---|
| DE | 19627891 | 1/1998 |
| FI | 87670 | 10/1992 |
| FI | 99284 | 4/1998 |
| GB | 2125461 | 3/1984 |
| JP | 222692 | 8/1993 |
| WO | 9632534 | 10/1996 |

* cited by examiner

*Primary Examiner*—Ira S. Lazarus
*Assistant Examiner*—K. B. Rinehart
(74) *Attorney, Agent, or Firm*—Steinberg & Raskin, P.C.

(57) ABSTRACT

The invention concerns a dryer section, comprising at least one dryer group (R) that makes use of single-wire draw and/or twin-wire draw and at least one suction roll (10) with which the web (W) to be dried is in direct contact. The surface construction of the suction roll (10) is of a fine structure so that the web (W) can be passed to run over the suction roll (10) in direct contact with the roll so that the web (W) is not damaged.

19 Claims, 5 Drawing Sheets

DRYER SECTION

FIELD OF THE INVENTION

The invention concerns a dryer section, comprising at least one dryer group that makes use of single-wire draw and/or twin-wire draw and at least one suction roll with which the web to be dried is in direct contact.

BACKGROUND OF THE INVENTION

As is known from the prior art, in multi-cylinder dryers in paper machines, twin-wire draw and/or single-wire draw is/are employed. In twin-wire draw, the groups of drying cylinders include two wires, which press the web, one from above and the other one from below, against heated cylinder faces. Between the rows of drying cylinders, which are usually horizonal rows, the web has free and unsupported draws, which are susceptible of fluttering, which may cause web breaks, in particular as the web is still relatively moist and, therefore, of low strength. This is why, in recent years, ever increasing use has been made of said single-wire draw, in which, in each group of drying cylinders, there is one drying wire only, on whose support the web runs through the whole group so that the drying wire presses the web on the drying cylinders against the heated cylinder faces, and on the reversing cylinders or rolls between the drying cylinders the web remains at the side of the outside curve. Thus, in single-wire draw, the drying cylinders are placed outside the wire loop, and the reversing cylinders or rolls inside the wire loop.

When paper is dried one-sidedly, the result is a tendency of curling of the sheet. When paper is dried by means of normal groups with single-wire draw from the side of its lower face, and if such asymmetric drying is extended over the entire length of a forward dryer section, the drying takes place so that first the side of the bottom face of the paper web is dried, and, when the drying makes progress, the drying effect also spreads to the side of the top face of the paper web. Thus, the dried paper is, as a rule, curled so that it becomes concave when viewed from above. In view of controlling the tendency of curling of paper, dryer sections have been used in which there are inverted dryer groups.

With respect to the prior art related to the control of curl, reference is made to FI Patent Application 971301, in which a method is described in the dryer section of a paper or board machine for the control of the curl of paper. In the method, steam treatment and/or moistening of the paper web is employed, and the operations carried out in order to control the curl of the paper web are carried out in a number of stages and/or when the temperature of the web is lower than 85° C., preferably lower than 75° C., and/or when the dry solids content of the web is in a range $k_1 \ldots k_2$, wherein $k_1$=the ultimate dry solids content−7%, and $k_2$=the ultimate dry solids content+3%. In said patent application, a paper or board machine is described which comprises at least a headbox, a former, a press, and a dryer section, in which steam boxes or moistening devices are employed for the control of the curl. There are at least two curl regulation devices in view of providing a curl regulation taking place in a number of stages.

The paper web can also be dried in dryer sections partly or fully based on impingement drying, and with respect to the prior art related to such dryers, reference is made to FI Patent Application 971713, in which a dryer unit and a dryer section that makes use of the unit are described. In the dryer unit, there is a drying-wire loop, and the dryer unit comprises a large-diameter impingement-drying and/or through-drying cylinder, which has been fitted in the interior of said drying-wire loop, and on the top of which cylinder/in the vicinity of which cylinder, at both sides of the cylinder, smooth-faced heated contact drying cylinders have been fitted, whose diameter is $D_2<D_1$. The impingement-drying and/or through-drying cylinder has been placed in spaces primarily below the floor level of the paper machine hall and is provided with a blow hood that can be opened and closed, so that removal of broke out of connection with said hood takes place primarily by the force of gravity. The central axes of the heated contact drying cylinders placed in the vicinity of, and at both sides of, the impingement-drying and/or through-drying cylinder have been placed in the vicinity of, or above, the floor level of the paper machine hall, and the wrapping sector b of the paper web to be dried on the outside face of said drying wire over said impingement-drying and/or through-drying cylinder is b>180°.

With respect to the prior art related to impingement drying, reference is also made to FI Patent Applications 963733 and 951746 (U.S. patent application Ser. No. 08/945224).

In the FI Patent Application 963733, a dryer section of a paper machine is described, which comprises drying modules, in which there is a drying-wire loop guided by guide rolls. The drying modules comprise a large-diameter impingement-drying and/or through-drying cylinder, which has been fitted inside the drying-wire loop. The outer mantle of the impingement-drying and/or through-drying cylinder is provided with grooves and/or it is permeable to the drying gas, and on the sector of contact with the drying wire a drying hood has been fitted, in whose interior, in the vicinity of the outer face of the web to be dried, there is a nozzle field or equivalent, through which a set of drying gas jets can be applied against the free outer face of the web to be dried. In the dryer section, a number of successive drying modules are employed, which have been fitted above the run of the paper web so as to apply drying energy to the paper web primarily from the side of its top face, and of the total drying energy of the dryer section, the major part, about 60 . . . 100%, is applied to the paper web by means of said drying modules from the side of the top face of the paper web to be dried.

In the FI Patent Application 951746, a dryer section concept for a paper/board machine is described, in which the dryer section comprises a number of groups of drying cylinders, which groups are exclusively provided with single-wire draw, on whose support the web is guided, meandering in loop shape, from a suction cylinder onto a drying cylinder and from the drying cylinder onto a second suction cylinder and from it further onto a second drying cylinder and further in the group. At least some of the drying cylinders comprise impingement drying units or equivalent in their connection, through which units a heated medium, preferably air or steam, is passed through the wire into contact with the web to produce a two-sided drying effect and to increase the drying capacity. The impingement drying units have been fitted in the end of the dryer section in such an area of dry solids content of the web that curl of the web can be affected and prevented by means of impingement drying.

With respect to impingement drying, reference is made further to FI Patent 100,013.

With respect to the prior art, reference is also made to FI Patent Application 960925, in which paper machine dryer sections provided with intermediate calendering are described.

Further, reference is made to a prior-art dryer section, in which the suction roll is provided with a drying-wire circulation of its own and which is described in the U.S. Pat. No. 3,816,941.

With respect to the prior art, reference can also be made to the U.S. Pat. No. 3,345,757, in which a dryer section is described in which the web runs around a drying cylinder and there is a blow hood on the cylinder, in connection with which hood an air-conditioning felt guide roll has been fitted.

From the JP publication 5-222692, a solution is known in which heatable suction rolls are used, against which the web is in direct contact. In this cited paper, suction rolls are also described which have a common contact and vacuum area in which a vacuum is applied to the web in the sector that is covered by the paper web. In addition to this, in the paper, impingement drying applied against said suction rolls is described.

With respect to the prior art, reference is also made to FI Patent 87,670, in which a suction roll provided with a resilient mantle is described, which suction roll forms a nip with drying cylinders with single-wire draw. In the arrangement suggested in this cited paper, between the suction roll and the web, there is a drying wire that circulates in the dryer group.

OBJECTS AND SUMMARY OF THE INVENTION

The prior-art arrangements described above involve drawbacks and problems, whose elimination is one of the objects of the present invention.

It is an object of the present invention to provide the dryer section with arrangements by whose means it is possible to obtain an increased drying capacity in the dryer section and, in this way, a more efficient dryer section and, thereby, lower costs.

It is a further object of the invention to provide a dryer section in which it is possible to control the curl of a web.

It is another object of the invention to provide a dryer section at least partly provided with no wire, in which case the cost of manufacture is considerably lower.

A further object of the invention is a dryer section which is connected with pre-calendering and/or in which the regulation of moisture profiles is easy.

Further, it is an object of the invention to provide a dryer section in which cross-direction shrinkage is prevented and/or whose runnability is good and/or in which the removal of broke is easy.

In view of achieving the objectives stated above and those that will come out later, the dryer section in accordance with the present invention is mainly characterized in that the surface construction of the suction roll is of a fine structure so that the web can be passed to run over the suction roll in direct contact with the roll so that the web is not damaged.

In a dryer section in accordance with the present invention, it is possible to use dryer-section suction rolls of at least three different types:

A roll of a normal construction with a drilled mantle and provided with a shrink sock, a roll of which type is in itself known from former rolls. A shrink sock is most commonly a fabric similar to a plastic wire, which is heated after it has been fitted onto the roll, and the sock is tightened onto the roll face when it shrinks. The keeping of the sock in contact with the roll can be secured further, in a way in itself known, by means of collars or bands to be fitted at the ends of the suction roll. One of the advantages of this embodiment is the reliability of the solution, because the technique is in itself conventional and known from the prior art. When necessary, for example, owing to contamination, the shrink sock can be replaced readily, and, moreover, the structure of the surface fabric can be optimized readily for various purposes (for example, in order to avoid marking). The shrink sock can, of course, also be a separate fabric of some other type to be fitted onto the face of the suction roll.

The mantle of the roll can also be made of a porous material. A suction roll made of a porous material is in itself known from other, small-scale applications (see, e.g., U.S. Pat. No. 3,630,424; column 1). One of the advantages of this solution is simplicity. This application is suitable in particular for the final end of the dryer section.

The roll can also be an entirely traditional suction roll in itself known with a drilled mantle, and possibly also grooved, however, with the difference being that both the holes and the grooves, if any, are smaller than those in a traditional suction roll in a dryer section, at least in the initial part of the dryer section, in order to avoid marking. The diameter of the holes is 0.5 . . . 3 mm, most advantageously 1 . . . 2 mm. The width of a groove is 0.5 . . . 3 mm, most advantageously 1 . . . 2 mm, the width of the ridge between the grooves is 2 . . . 10 mm, most appropriately 2 . . . 5 mm, and the depth of a groove is 2 . . . 4 mm. A suction roll with small holes is also known from other applications (see U.S. Pat. No. 3,630,424). An advantage of this embodiment is a traditional technique of manufacture.

In respect of the rest of its construction, the suction roll of a dryer section in accordance with the present invention is, for example, the applicant's a suction roll sold by the applicant under the name VAC roll (FI 83,680), or a conventional suction roll for a dryer section as described, for example, in the patent GB 2,125,461, in which suction roll there is a suction sector in the interior of the suction roll. If necessary, the suction roll is provided with a blow sector, by whose means it is guaranteed that the web is separated from the face of the suction roll. In a dryer section, such sucking and blowing rolls were used earlier as felt/wire guide rolls between the drying cylinders in twin-wire draw in order to air-condition the "pocket" that remains between the cylinders. The scope of the present invention also includes suction rolls in which the vacuum is produced by means of a suction box placed outside the roll (see, e.g., U.S. Pat. No. 4,359,828 and FI 943654).

The scope of the invention also includes the idea that suction rolls of different constructions/sizes are used in different parts of the dryer section. For example, in the initial part of the dryer section, it is more advantageous to use a suction roll with a shrink sock than a porous roll so as to avoid blocking of possible holes in the roll.

The scope of the invention also includes the idea that various embodiments of the present invention are applied together with traditional cylinder drying, or that different embodiments of the dryer section in accordance with the present invention are used in different parts of the dryer section.

An exemplifying embodiment of the present invention includes a suction roll and an impingement drying hood fitted on said roll, which have been fitted between two normal groups with single-wire draw. When the aim is to obtain additional drying capacity by means of the solution, one or several such units are fitted in the area of principal evaporation. From the point of view of regulation of curl, the unit is fitted preferably in the final end of the dryer section.

In a suction roll in the dryer section in accordance with the invention, there can be a "draw suction" of high vacuum in order to make the web to adhere to the roll face, after that there is favourably a less intensive "holding suction", and finally there is a "blow" zone that secures the transfer of the web.

In a preferred embodiment of the present invention, the invention is utilized for regulation of curl and, if desired, also for regulation of the moisture profile. In this embodiment, the last cylinder in the dryer section has been substituted for by a suction roll, in accordance with the invention, against which suction roll impingement drying is carried out. In this way drying of the web is accomplished from the opposite side, compared with the drying cylinders of single-wire draw. By means of regulation of the blow velocity, and the moisture and the velocity of the medium, an efficient mode of regulation of curl is obtained.

According to a preferred alternative embodiment of the invention, for example, a large-diameter suction roll provided with a shrink sock is placed between the press section and a cylinder dryer group, and impingement drying hoods are fitted onto said suction roll. This embodiment is particularly favourable when it is desirable to increase the dry solids content of the web before the first group of drying cylinders and in this way to improve the runnability of the dryer section. By means of this solution, an impingement drying distance of considerable length is obtained in a relatively short space in the longitudinal direction, and, in this way, an evaporation capacity higher than that of, for example, horizontal impingement drying is obtained.

In a dryer section in accordance with the above embodiment, the suction roll can also be a VAC roll with no inside suction sectors, and the web is introduced onto said suction roll by means of an upper press fabric, either a belt or a felt.

According to an embodiment of the present invention, a drying cylinder with single-wire draw is substituted for by a suction roll provided with a wire. In particular, when accomplished in the final end of the dryer section, the web can be dried in this way from its top face, and a double-sided drying favourable in view of the control of curl can be achieved.

According to an embodiment of the invention, the suction/blow roll whose face the web follows is placed between two drying cylinders so that it forms a, preferably light, nip with said cylinders. On the drying cylinders, the web is pressed by the drying wire. In this solution, blowing can be arranged from the roll into an upper pocket, in which case both ventilation of the pocket is produced and separation of the web by the effect of suction/adhering of the web to the face of the drying cylinder is secured. This solution is particularly usable when attempts are made to minimize the cross-direction shrinkage of the web.

In an embodiment of the invention, for example, a VAC roll provided with a shrink sock (fabric sleeve) is fitted between two drying cylinders in contact with said cylinders. On the cylinders, there is no wire to press the web against the cylinders. The cylinders and the hood fitted on them operate, so to say, in a way similar to a Yankee cylinder and a hood. By means of this solution, a really high drying capacity can be provided in a single-row dryer section. With this solution, the web shrinks relatively freely on the faces of the cylinders, which can be counteracted, for example, by means of suction zones fitted in the lateral areas, by means of which zones the edges of the web are held in their place. There are also paper grades in which drying-shrinkage is desirable, among other things sack papers.

In a further embodiment of the invention, the suction rolls in the upper row and in the lower row form nips with each other, and the suction rolls are preferably provided with separation blowing, which secures the runnability. It is an advantage of this embodiment, and so also of other embodiments in which a suction roll and a cylinder form a nip with each other, that in this way calendering of the web can be carried out at the same time at least partially in the dryer section.

Depending on the embodiment, by means of the present invention at least the following advantages are obtained:

- increased drying capacity,
- possibility to control the curl,
- dryer section with no wire→lower costs,
- pre-calendering,
- easy regulation of moisture profiles by means of blow hoods,
- prevention of cross-direction shrinkage, and/or
- good runnability and easy removal of broke.

BRIEF DESCRIPTION OF THE DRAWINGS

In the following, the invention will be described in more detail with reference to the figures in the accompanying drawing, the invention being, however, not supposed to be strictly confined to the details of said illustrations.

DETAILED DESCRIPTION OF THE INVENTION

Figure 1:
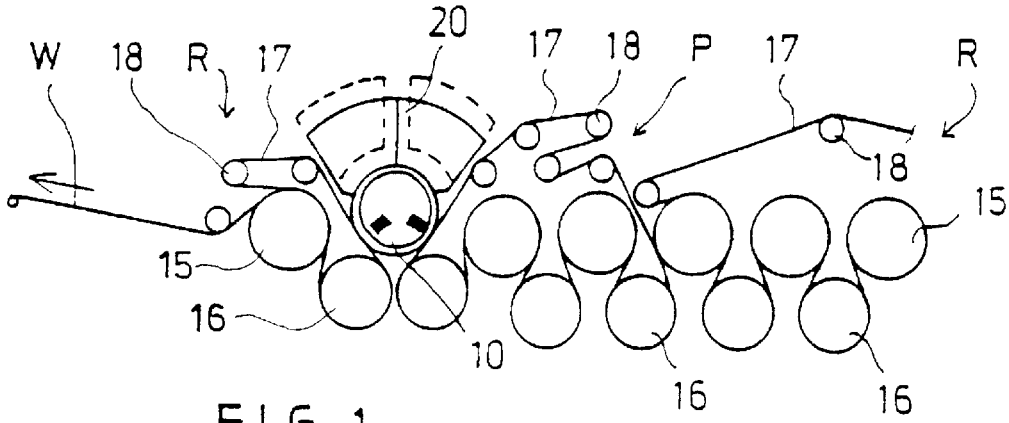
FIG. 1 is a schematic illustration of an exemplifying embodiment of the invention in which a suction roll and an impingement drying hood fitted on said roll have been fitted between two normal groups with single-wire draw.

In the exemplifying embodiment shown in FIG. 1, a suction roll 10 and an impingement drying hood 20 fitted on it have been fitted between two normal groups R with single-wire draw. In the exemplifying embodiment shown in the figure, the web W comes from the drying wires 17 of the dryer groups R with single-wire draw into connection with the suction roll 10. The drying cylinders placed in the upper rows in the groups R with single-wire draw are denoted with the reference numeral 15, and the reversing rolls or cylinders placed in the lower rows are denoted with the reference numeral 16. The drying wire 17 runs meandering from a drying cylinder 15 in the upper row onto a reversing roll 16 in the lower row, while guided by guide rolls 18, and presses the web W to be dried, on the drying cylinders 15, against the smooth heated faces of said cylinders, and on the reversing cylinders 16 the web W remains at the side of the outside curve on the outer face of the wire 17. On the reversing cylinders 16 the web W is kept reliably on support of the wire 17 against the effect of centrifugal forces by the effect of a vacuum present in the grooved faces of the reversing cylinders 16 or in the perforated mantles of corresponding suction rolls. After the suction roll 10 and the impingement drying hood 20 fitted in connection with said suction roll, the paper web to be dried is transferred onto the drying wire 17 of the next, for example the last, group R with single-wire draw, the web running further on the support of said wire over the suction roll 16 and the drying cylinder 15, which cylinder can be a traditional drying cylinder or a what is called cooling cylinder. If an additional drying capacity is aimed at by means of such a solution, one or several such units formed by a suction roll 10 and by an impingement drying hood 20 are placed in the area of principal evaporation. In view of control of curl, it is favourable to place such a unit in the final end of the dryer section, as is shown in the figure. Thus, the arrangement in accordance with the invention can be used as a favourable embodiment alternative to a solution in which the impingement drying unit has a wire circulation of its own.

Figure 2:
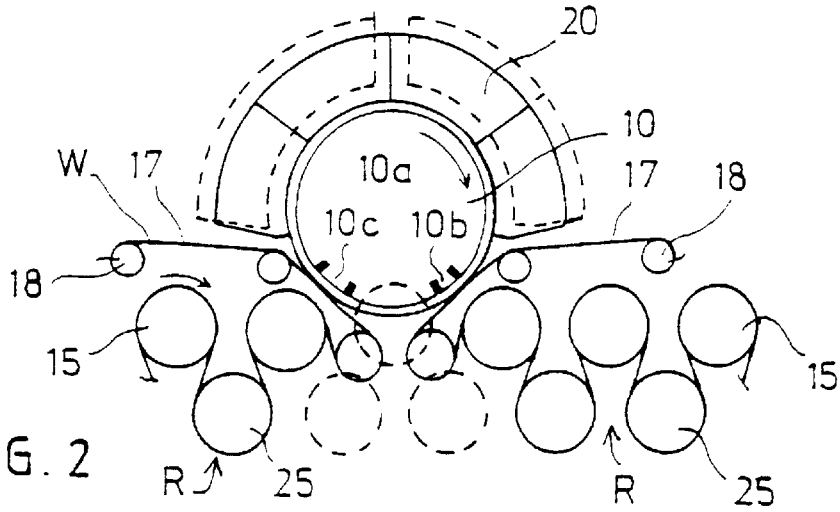
FIG. 2 is a schematic illustration of an exemplifying embodiment of the invention in which there are a suction roll and an impingement drying hood fitted on the roll and in which the suction of the roll can be regulated and the roll also includes a blow zone, which secures the transfer of the web.

FIG. 2 illustrates a solution whose principle corresponds to that shown in FIG. 1, and corresponding parts are denoted with the same reference numerals. In the exemplifying embodiment shown in FIG. 2, the roll 10 can be provided with a "draw suction" 10*c* of high vacuum in order to affix the web W to the roll 10 face, after that there is preferably a lower "hold suction" 10*a*, by whose means the web W is kept on the face of the suction roll 10, and finally there is a "blow" zone 10*b*, which secures the transfer of the web W. This exemplifying embodiment of the invention has been arranged in connection with an existing dryer section geometry with twin-wire draw, and the drying cylinders in the upper row are denoted with the reference numeral 15, and the previous drying cylinders in the lower row, which cylinders operate here also as reversing cylinders, with the reference numeral 25. The web W arrives on support of the drying wire 17, and it is passed from the group R with single-wire draw onto the suction roll 10, in whose connection an impingement drying hood 20 has been fitted. The web W, being sucked by the draw suction zone 10*c*, is affixed to the face of the suction roll 10, and it runs onto the blow zone 10*b*, by whose means the web W is transferred into the next group R with single-wire draw, and between said zones 10*c* and 10*b* the web is held by the hold suction 10*a* in connection with the cylinder 10 or suction roll 10 while the impingement drying hood 20 dries the paper web W by means of impingement drying.

Figure 3:
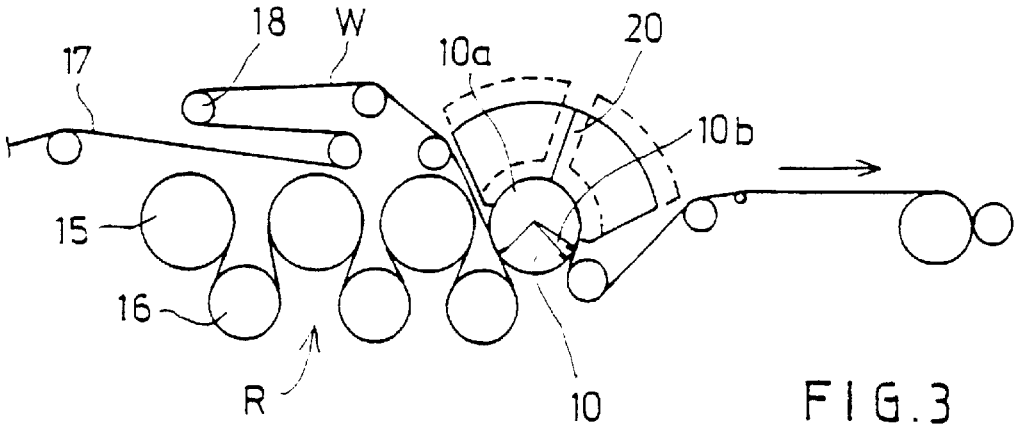
FIG. 3 is a schematic illustration of an exemplifying embodiment of the invention in which the last cylinder in the dryer section has been substituted for by a suction roll, against which impingement drying is carried out.

FIG. 3 illustrates an advantageous mode of using the invention for regulation of curl and also for regulation of moisture profile. Therein, in accordance with the invention, the last cylinder in the dryer section has been substituted for by a suction roll 10, against which impingement drying is carried out from an impingement drying hood 20. In this way, drying of the web W is achieved from the side opposite to the side of drying on the drying cylinders 15 in the groups R with single-wire draw. By means of regulation of the blow velocity, moisture and/or velocity of the medium, efficient means are provided for the control of curl and moisture profile. The paper web W to be dried is passed from the drying wire 17 of the group R with single-wire draw into connection with the suction roll 10 onto its "hold suction" zone 10*a*, and from the blow zone 10*b* of the suction roll 10 the web W is transferred to finishing.

Figure 4:
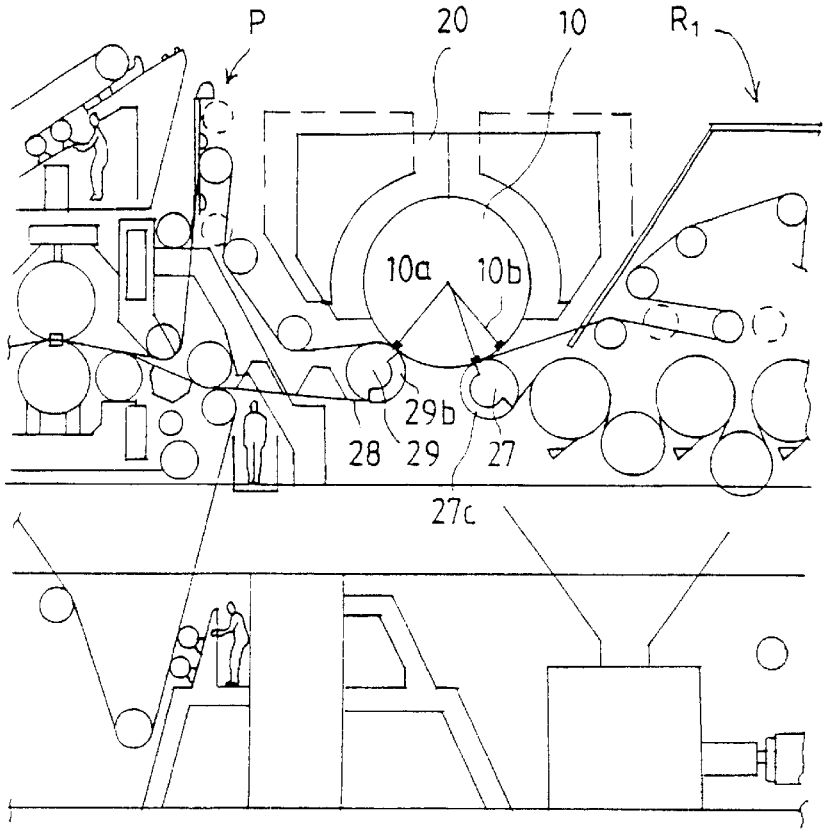
FIG. 4 is a schematic illustration of an exemplifying embodiment of the invention in which a large-diameter suction roll provided with a shrink sock has been fitted between the press section and a cylinder dryer group and in which impingement drying hoods have been fitted on the suction roll.

FIG. 4 shows a further advantageous alternative embodiment of the invention. Therein, for example, a large-diameter suction roll 10 provided with a shrink sock (fabric sleeve) has been fitted between the press section P and the first cylinder dryer group $R_1$ in the dryer section, and on said suction roll 10, impingement drying hoods 20 have been fitted for impingement drying. This solution is particularly favourable when it is desirable to increase the dry solids content of the web W before the first group $R_1$ of drying cylinders and thereby to improve the runnability of the dryer section. By means of the solution, in a relatively short space in the longitudinal direction an impingement drying distance of considerable length is provided, and, thus, an evaporation capacity is obtained that is higher than, e.g., in horizontal impingement drying. In the exemplifying embodiment shown in FIG. 4, the web W is passed from the press felt 28 of the press section P over a guide roll 29 onto the suction roll 10. The suction roll 10 placed in connection with the impingement drying hood 20 is provided with two zones, i.e. a hold suction zone 10*a* and a blow zone 10*b*, by whose means the web W is separated from the face of the suction roll 10. The web W is guided onto a guide roll 27 and further into the first dryer group $R_1$ in the dryer section. The guide rolls 27,29 form nips with the suction roll 10, and the guide roll 29 in the press section includes a blow zone 29*b* in view of separating the web W from its face, and the guide roll 27 includes a suction zone 27*c* so as to affix the web W onto its face.

Figure 5:
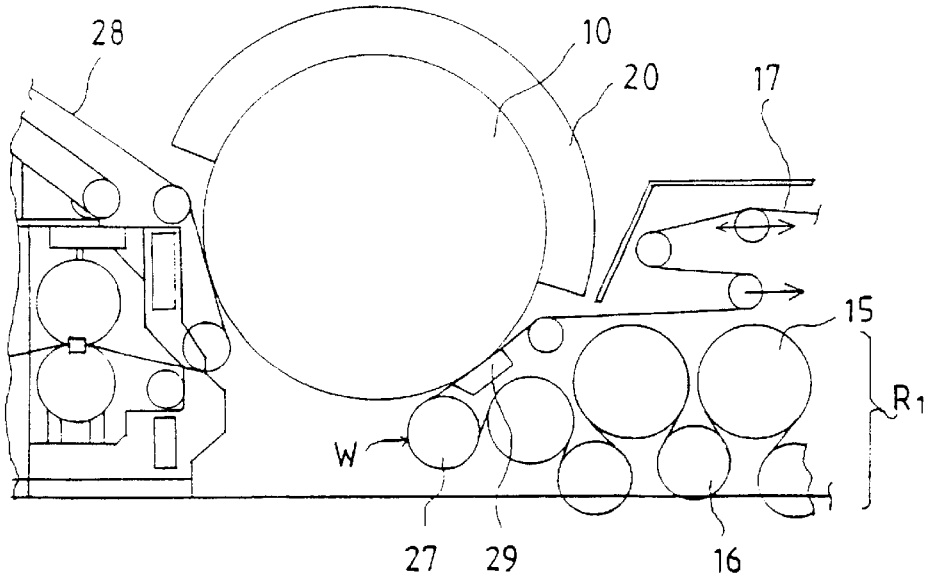
FIG. 5 is a schematic illustration of an exemplifying embodiment of the invention in which a roll with no inside suction sectors is employed as a suction roll.

FIG. 5 shows a solution corresponding to that shown in FIG. 4, and corresponding parts are denoted with the same reference numerals, but the suction roll 10 is a VAC roll with no inside suction sectors, and the web W is passed onto said suction roll 10 by means of an upper press fabric 28, either a belt or a felt. The web W is passed from the suction roll 10 onto the drying wire 17 of the first dryer group $R_1$ in the dryer section, the web W being separated from the suction roll 10 and affixed to said wire 17 by means of a suction box 29, and the web W is guided over a guide roll 27 so that it runs in single-wire draw into the dryer group $R_1$.

Figure 6:
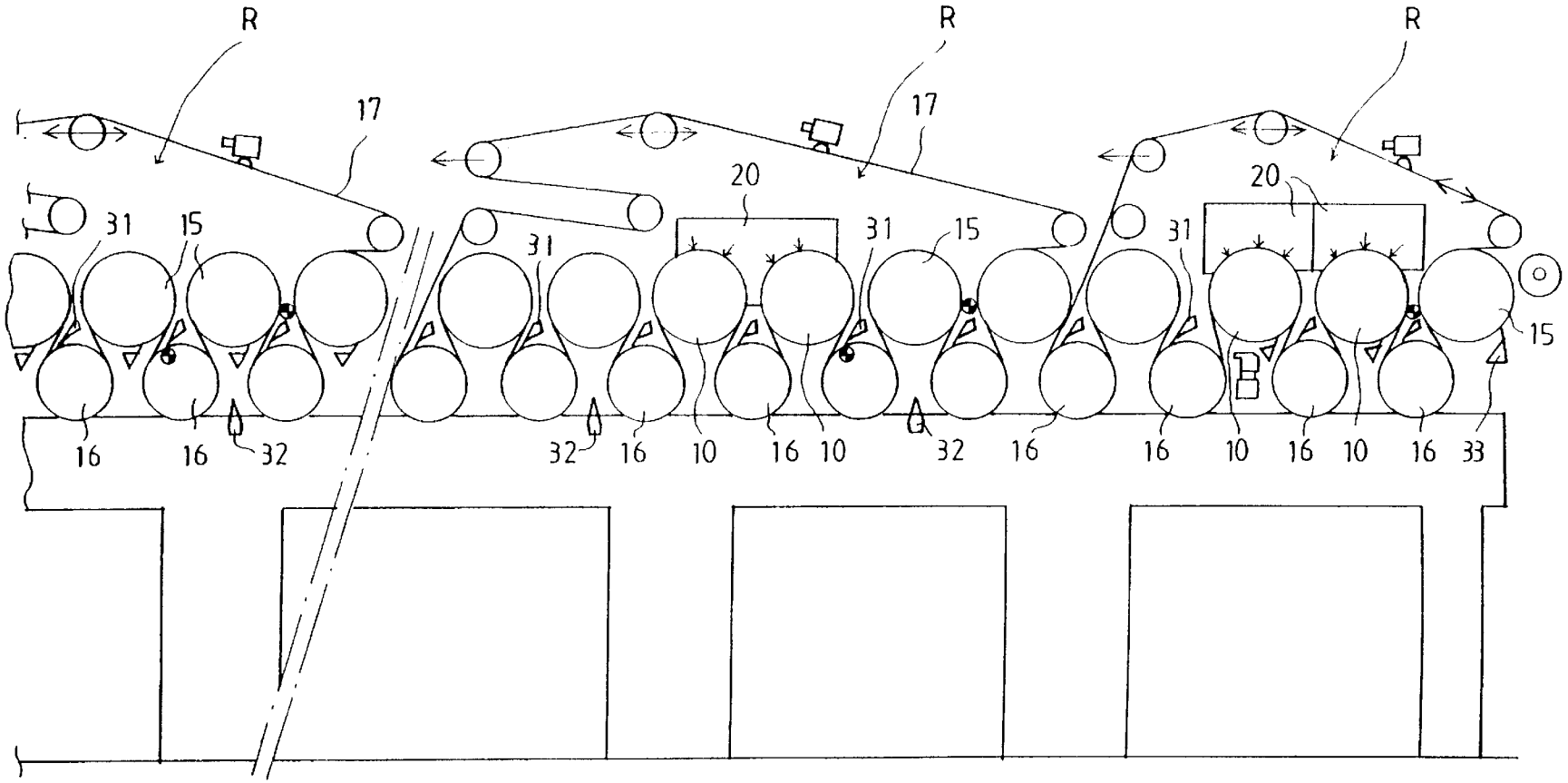
FIG. 6 is a schematic illustration of an exemplifying embodiment of the invention in which a drying cylinder with single-wire draw has been substituted for by a suction roll provided with a wire.

FIG. 6 shows how, in accordance with the invention, a drying cylinder 15 in a group R with single-wire draw has been substituted for by a suction roll 10 provided with a wire. In particular, if carried into effect in the final end of the dryer section, in this way the web W can be dried from the side of its top face, whereby a two-sided drying favourable in view of the control of curl is achieved. In FIG. 6, in two dryer groups R in the dryer section, impingement drying hoods 20 have been fitted, which have been placed in dryer groups R that make use of normal single-wire draw, in which groups, thus, drying cylinders 15 have been substituted for by suction rolls 10. In particular, if a suction roll includes a blow zone when the web is separated from the roll face along with the wire, it i s possible to avoid a vacuum formed in said opening gap and the risk of runnability caused by said vacuum. The web runs in the dryer group R on support of the wire 17. In the figure, blow-suction boxes 31, pocket ventilation boxes 32 an d doctors 33 have also been shown, which are used commonly in groups R with single-wire draw. Of course, these auxiliary devices can also be present in the other exemplifying embodiments shown in the figures, in which figures such devices have been omitted in the present description for the sake of simplicity.

Figure 7:
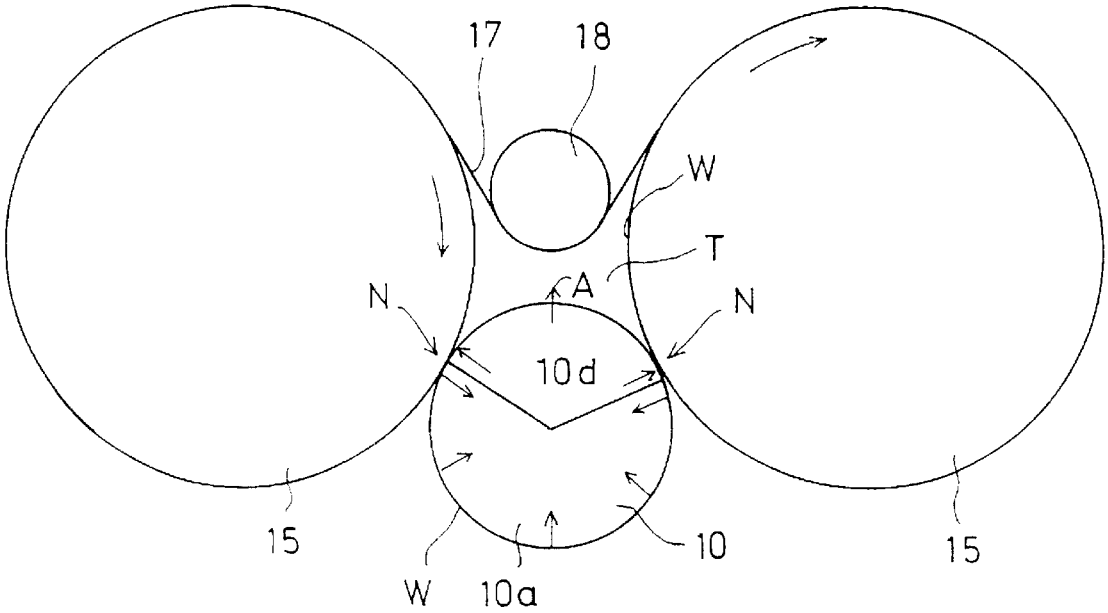
FIG. 7 is a schematic illustration of an exemplifying embodiment of the invention in which a suction/blow roll, whose face the web follows, has been fitted between two drying cylinders so as to form nips with said cylinders

FIG. 7 shows a concept i n which a suction/blow roll 10, whose face the web W follows, has been fitted between two drying cylinders 15 so that it forms (light) nips N with said cylinders 15. The blow zone of the roll 10, by whose means the upper pocket space T is ventilated, is denoted with the reference numeral 10*d*, and the suction zone with 10*a*, by means of which zone 10*a* the web W is kept on the face of the suction roll 10. On the drying cylinders 15, the web W is pressed by the drying wire 17 in the usual way. The guide roll of the drying wire 17 is denoted with the reference numeral 18. In this solution, a blowing A from the roll 10 into an upper pocket T is not indispensable, but by means of said blowing, both ventilation of the pocket T is produced and it is ensured that the web W is separated from the suction/adhering effect of the suction/blow roll 10 and on to the face of the second drying cylinder 15. This solution is particularly usable in an attempt to minimize cross-direction shrinkage of the web W. The upper cylinders 15 are placed in a way similar to twin-wire draw, i.e. the wire 17 is separated from contact with the paper W and with the cylinder 15.

Figure 8:
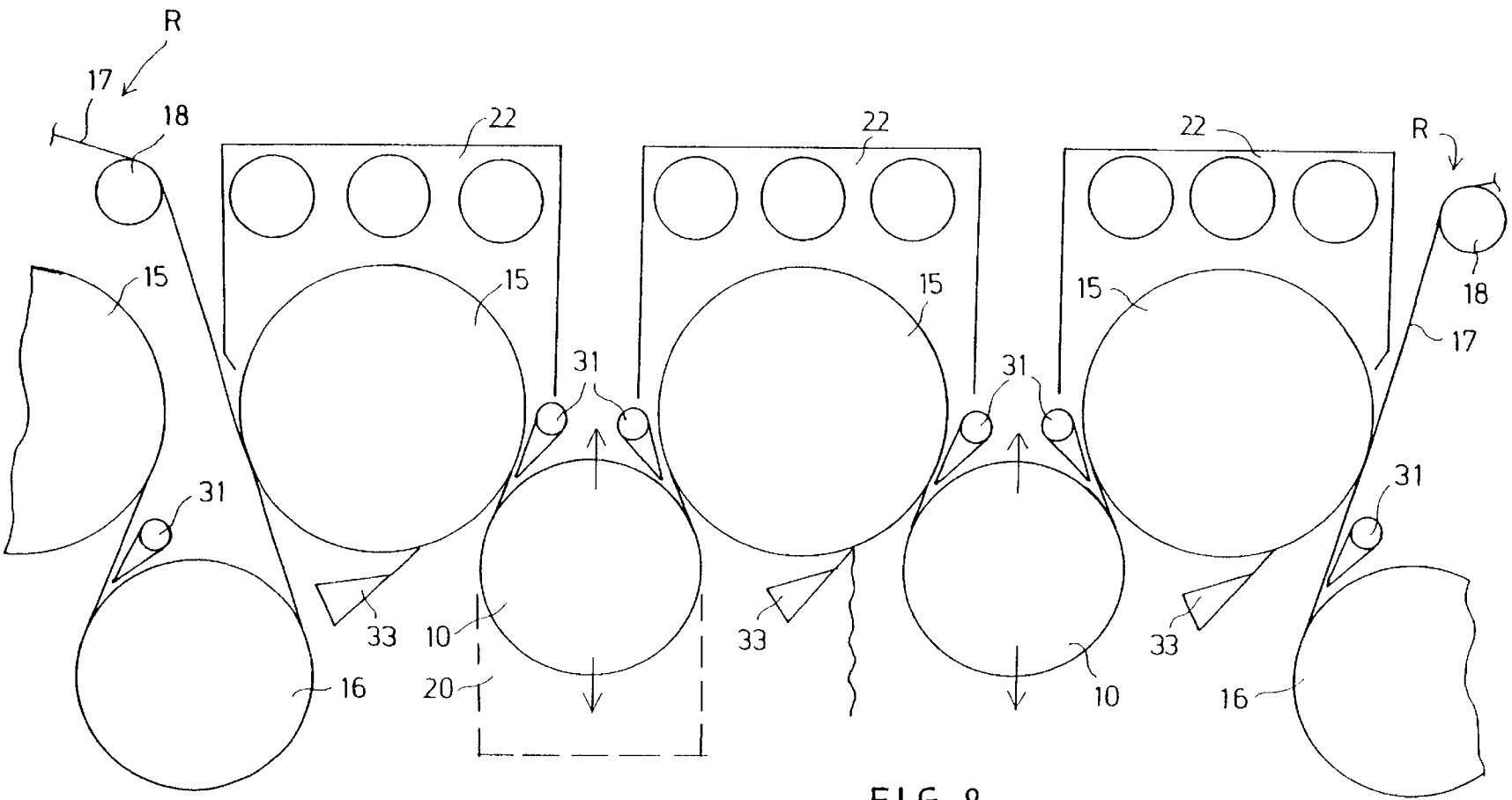
FIG. 8 is a schematic illustration of an exemplifying embodiment of the invention in which a suction roll has been fitted between two drying cylinders in contact with said cylinders.

In the solution shown in FIG. 8, a VAC roll 10 provided, e.g., with a shrink sock or with a coating has been fitted between two drying cylinders 15 at a short distance of 0 . . . 100 mm, preferably 0 . . . 20 mm, from said cylinders or in contact with said cylinders. Neither the cylinders 15 nor the rolls 10 have any wire to press the web W against them. The cylinders 15 and the hood 22 fitted on them operate in a way similar to a Yankee cylinder and a hood. By means of this solution, in a single-row dryer section, a really high drying capacity is achieved. On the contrary, the web W shrinks rather freely on the faces of the cylinders 15 unless the edges of the web W are held in their place, for example, by means of suction zones fitted in the lateral areas. There are also paper grades for which a drying shrinkage is desirable, among other things sack papers. In this exemplifying embodiment of the invention, in the forward dryer section, drying takes place alternatingly by means of a group R with single-wire draw and by means of a cylinder group Rx with no wire. In a group Rx with no wire, two-sided drying is constructed by means of blow boxes 22. Drying cylinders 15 operate as upper rolls, and VAC rolls 10 are placed in lower positions. The blow hoods are placed either in the upper position 22 and/or in the lower position 20. The group Rx can also be inverted. Good runnability is secured by means of blow boxes 31. By means of these boxes, a vacuum is produced which helps the web to be separated from the face of the cylinder in a controlled way. By means of a blow box, formation of a detrimental pressure is also prevented in the closing gap formed by the web and by the suction roll.

Figure 9:
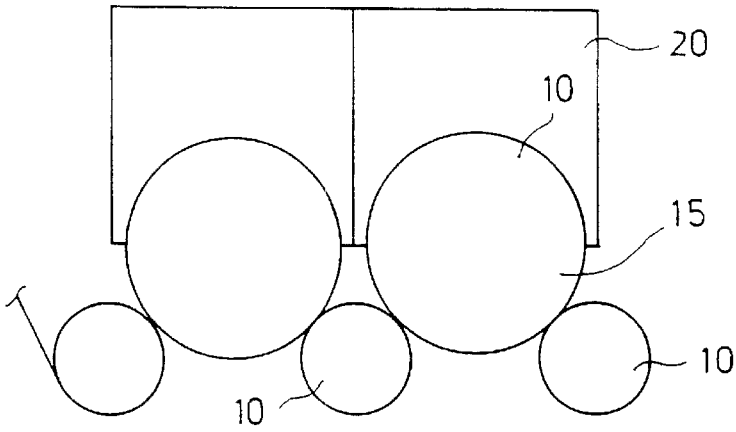
FIG. 9 illustrates an exemplifying embodiment of the invention in which a suction roll and a cylinder form a nip with each other.

In the exemplifying embodiment shown in FIG. 9, the suction rolls 10 in the upper and lower rows form nips N with each other. In this way, in the dryer section, it is possible, at the same time, to carry out calendering of the web at least partially. The suction rolls 10 are most advantageously provided with separation blowing which secures the runnability. The suction rolls 10 in the upper row, whose diameters are larger than the diameters of the suction rolls in the lower row, are provided with impingement drying hoods 20, and the suction rolls 10 in both rows are provided with wire coatings. A suction roll 10 in the upper row can also be a cylinder 15.

In the different exemplifying embodiments of the invention described above in relation to FIGS. 1 to 9, corresponding parts or parts with functions of corresponding types have been denoted with the same reference numerals, and different exemplifying embodiments can be combined in the dryer section in many different ways.

In the description, the designation roll has been used for a suction roll, whereby, however, no stand is supposed to be taken to the size of its diameter. The diameter of a suction roll 10 can vary in a range 500 . . . 8000 mm, depending on the exemplifying embodiment of the invention. A suction roll in accordance with the invention includes a suction zone, and the magnitude of the suction sector 10*a* is>200°, preferably 210 . . . 280°. The magnitude of the sector 10*c* of an intensive hold suction zone is 5 . . . 30°, preferably 10 . . . 20°. The magnitude of the blow sector 10*b* is 5 . . . 30°, preferably 10 . . . 20°. When a suction roll 10 is also used for ventilation of the pocket space T, the magnitude of the sector of the blow zone 10*d* is<180°, preferably 100 . . . 150°. The suction zone of a suction roll 10 is preferably open towards the top, and so in particular in exemplifying embodiments in which an impingement drying hood 20 is employed in the area of an impingement drying hood. In accordance with the invention, the web is in direct contact with the suction roll 10, and the web covers the suction zone over a substantial area of said zone. In the suction rolls in accordance with the invention, the typical vacuum levels that are employed are 0.5 . . . 10 kPa, preferably 1 . . . 3 kPa.

Thus, as a suction roll as shown in FIGS. 1 to 9, dryer section suction rolls of at least three different types are used, depending on the particular application. In order that the web W should not be damaged on the face of the suction roll 10 when it runs over the roll, the surface construction of the suction roll is of fine structure, and it is possible to use a roll with a drilled mantle of a normal construction provided with a shrink sock or a roll whose mantle has been made of a porous material, or the roll can also be an entirely conventional drilled-mantle or possibly also grooved suction roll in itself known whose holes and possible grooves, if any, are smaller than those in a conventional suction roll in a dryer section.

In an exemplifying embodiment of the invention in which a drilled-mantle roll of normal construction provided with a shrink sock is used, the material of the shrink sock is typically PES monofilament plastic. The roll mantle is provided with through bores, and its bore size is 4 . . . 8 mm, preferably 5 . . . 6 mm, the countersink diameter of the bore is 8 . . . 12 mm, preferably 9 . . . 10 mm, and the open area of the face is 40 . . . 80%, preferably 60 . . . 75%. When a roll with a mantle with through bores and grooves is used, the diameter of the bores is 0.5 . . . 3 mm, preferably 1 . . . 2 mm, the percentage of bores is<3%, preferably<1%, the width of the grooves is 0.5 . . . 3 mm, preferably 1 . . . 2 mm, the depth of the grooves is 2 . . . 4 mm, preferably 3 . . . 4 mm, and the proportion of grooves is 10 . . . 60%, preferably 40 . . . 50%.

A porous suction roll has been made favourably by means of powder-metallurgic processes out of austenitic-ferritic stainless steels. As the mantle material of a suction roll, it is also possible to use, for example, aluminum foam or sintered metals.

One possible fabric that can be used as a roll coating is a fabric structure in which, at each side of a felt-like porous layer, there is a metal wire or plastic wire of high tensile strength. The felt layer efficiently prevents marking which might be possibly caused otherwise, e.g., by grooves, and, thus, the solution permits larger dimensions of holes/grooves in a suction roll, and, thus, a mantle of a suction roll which is easier and less expensive to manufacture.

As a roll coating, it is also possible to use a metal wire, which can be, most advantageously, fixed by welding onto the mantle of the underlying suction roll. Such steel-metal wires suitable for this purpose are available commercially. In different parts of the dryer section, suction rolls of different constructions/sizes are used, and different exemplifying embodiments of the present invention are used together with traditional cylinder drying, or in different parts of the dryer section an applicable embodiment of the present invention is employed so that, in different exemplifying embodiments, when the web reaches direct contact with the face of a suction roll, the web is not damaged on the face of the suction roll.

A preferred embodiment of the invention includes a suction roll 10 and an impingement drying hood 20 fitted on said roll, and in dryer sections in accordance with the invention, thus, impingement drying is used in combination with a suction roll in accordance with the invention or with a drying cylinder included in a group. Even if, in the description, the term "impingement drying" has been used, it is also possible to replace impingement drying by through-drying in applicable exemplifying embodiments of the invention.

Above, the invention has been described with reference to some preferred exemplifying embodiments of same only, the invention being, however, not supposed to be strictly confined to the details of said embodiments.

What is claimed is:

1. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the suction roll (10) is provided with a coating which is permeable to air.

2. A dryer section as claimed in claim 1, wherein the mantle of the suction roll (10) is made of a porous material.

3. A dryer section as claimed in claim 1, wherein the suction roll (10) is a drilled-mantle roll.

4. A dryer section as claimed in claim 1, wherein a nip is formed between the at least one suction roll (10) and at least one of an adjacent suction rolls (16) and drying cylinders (15).

5. A dryer section as claimed in claim 1, wherein the at least one suction roll (10) and the impingement drying equipment (20) operatively coupled thereto are fitted between two dryer groups (R) with single-wire draw.

6. A dryer section as claimed in claim 5, wherein the suction roll (10) and the impingement drying equipment (20) operatively coupled thereto are placed in the area of principal evaporation in the dryer section.

7. A dryer section as claimed in claim 1, wherein the at least one suction roll (10) and the impingement drying equipment (20) operatively coupled thereto constitute a last drying unit in the dryer section.

8. A dryer section as claimed in claim 1, wherein the at least one suction roll (10) replaces a drying cylinder (15) in a dryer group (R) of the dryer section.

9. A dryer section as claimed in claim 1, wherein the at least one suction roll (10) is situated between adjacent drying cylinders (15) in a dryer group, each of said drying cylinders (15) being operatively coupled to the impingement drying equipment (20).

10. A dryer section as claimed in claim 1, wherein the at least one suction rolls (10) of the dryer section comprise a plurality of suction rolls and each of said plurality of suction rolls are of different constructions and sizes.

11. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the suction roll (10) is provided with a shrink sock.

12. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the mantle of the suction roll has been coated with a metal wire.

13. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the at least one suction roll (10) is a grooved roll having a mantle drilled with a plurality of holes, wherein the diameter of the holes drilled in said mantle is at a maximum 3 mm and wherein the size of the grooves is at a maximum 3 mm and wherein the percentage of holes in the mantle is less than 3% and the percentage of grooves in the mantle is from 10 to 60%.

14. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the at least one suction roll (10) comprises:

at least one of a zone (10*c*) of intensive vacuum structured and arranged to affix the web (W) onto the mantle of the suction roll (10) and a hold suction zone (10*a*) structured and arranged to maintain the web (W) on the mantle of the suction roll (10); and a blow zone (10*b*) structured and arranged to transfer the web (W) from the mantle of the suction roll (10) to a further treatment station in the paper machine.

15. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the at least one suction roll (10) comprises:

a hold suction zone (10*a*) structured and arranged to maintain the web (W) on the mantle of the suction roll (10); and a blow zone (10*d*) structured and arranged to ventilate an adjacent pocket space (T) bounded by the at least one suction roll (10), a pair of drying cylinders (15) and a drying wire (17).

16. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the at least one suction roll (10) and the impingement drying equipment (20) operatively coupled thereto are fitted between a press section (P) and a first dryer group ($R_1$) of the dryer section, whereby the at least one suction roll (10) and the impingement drying equipment (20) act as a first drying unit in the dryer section.

17. A dryer section for drying a web (W) in a paper machine, comprising:

at least one dryer group (R) that makes use of at least one of a single-wire draw and a twin wire draw, wherein said at least one dryer group (R) comprises:

at least one suction roll (10) structured and arranged to be in direct contact with the web (W) to be dried, wherein the at least one suction roll (10) comprises:

a mantle having a fine surface construction, whereby when the web (W) to be dried is passed over the at least one suction roll (10) the web (W) is not damaged; and an impingement drying equipment (20) operatively coupled to said at least one suction roll (10), whereby said impingement drying equipment (20) is structured and arranged to dry the web (W); and wherein the dryer section further comprises:

an upper row of suction rolls (10); and a lower row of suction rolls (16), wherein said upper row of suction rolls and said lower row of suction rolls are structured and arranged to define nips (N) formed therebetween.

18. A dryer section as claimed in claim 17, further comprising:

separation blowing means in connection with the suction rolls of the upper row of suction rolls and the suction rolls of the lower row of suction rolls said separation blowing means being structured and arranged to secure the web (W) against the at least one suction roll during the run of the paper machine.

19. A dryer section for drying a web (W) in a paper machine, comprising:

at least one dryer group (R) structured and arranged to dry the web (W); and at least one suction roll (10) operatively coupled to said at least one dryer group (R), the at least one suction roll (10) is structured and arranged to be in direct contact with the web (W) to be dried, wherein the at least one suction roll (10) includes a mantle having a surface which is of a fine construction, such that when the web (W) to be dried is passed over the mantle of the at least one suction roll (10) the web (W) is not damaged; and an impingement drying equipment (20), said impingement drying equipment being operatively coupled to said at least one suction roll (10), whereby said impingement drying equipment (20) is structured and arranged to dry the web (W); and wherein the suction roll (10) is provided with a coating which is permeable to air.

* * * * *